US008070515B2

(12) United States Patent
Nagata et al.

(10) Patent No.: US 8,070,515 B2
(45) Date of Patent: Dec. 6, 2011

(54) SHIELD CASE WITH U-SHAPED BASE WITH A FIRST PLATE AND SECOND PLATES AND SIDE WALLS PARALLEL TO SECOND PLATES

(75) Inventors: Takayuki Nagata, Yao (JP); Takao Asano, Isesaki (JP)

(73) Assignee: Hosiden Corporation, Yao-Shi (JP)

( * ) Notice: Subject to any disclaimer, the term of this patent is extended or adjusted under 35 U.S.C. 154(b) by 0 days.

(21) Appl. No.: 12/820,466

(22) Filed: Jun. 22, 2010

(65) Prior Publication Data

US 2011/0034078 A1 Feb. 10, 2011

(30) Foreign Application Priority Data

Aug. 7, 2009 (JP) ..... 2009-185114

(51) Int. Cl.
*H01R 13/648* (2006.01)

(52) U.S. Cl. ..... 439/607.13

(58) Field of Classification Search ..... 439/607.13, 439/607.35, 607.51, 607.55
See application file for complete search history.

(56) References Cited

U.S. PATENT DOCUMENTS

| | | | | |
|---|---|---|---|---|
| 5,221,219 | A * | 6/1993 | Thomson | 439/762 |
| 6,350,134 | B1 * | 2/2002 | Fogg et al. | 439/79 |
| 6,595,801 | B1 * | 7/2003 | Leonard et al. | 439/607.55 |
| 7,077,668 | B2 * | 7/2006 | Lapidot et al. | 439/108 |
| 7,435,110 | B2 * | 10/2008 | Xiao et al. | 439/107 |
| 7,473,143 | B2 * | 1/2009 | Chen | 439/670 |
| 7,731,536 | B2 * | 6/2010 | Okayasu | 439/607.51 |
| 7,785,149 | B2 * | 8/2010 | Kamata et al. | 439/607.35 |
| 2007/0238330 | A1 * | 10/2007 | Xiao et al. | 439/101 |
| 2010/0233905 | A1 * | 9/2010 | Nagata | 439/607.13 |
| 2010/0322566 | A1 * | 12/2010 | Zheng et al. | 385/74 |

FOREIGN PATENT DOCUMENTS

| | | | |
|---|---|---|---|
| EP | 1369958 | A1 | 12/2003 |
| JP | 11-67365 | | 3/1999 |
| JP | 2007-149602 | A1 | 6/2007 |
| JP | 2007-220591 | | 8/2007 |
| JP | 2007-220591 | A1 | 8/2007 |
| WO | WO03/012928 | A1 | 2/2003 |
| WO | WO2009/055684 | A1 | 4/2009 |

OTHER PUBLICATIONS

European Search Report dated Oct. 29, 2010.

* cited by examiner

*Primary Examiner* — Chandrika Prasad
(74) *Attorney, Agent, or Firm* — Kratz, Quintos & Hanson, LLP

(57) ABSTRACT

A shield case of the invention includes a base of a generally U-shape in front view having widthwise end portions, the end portions each having a front surface and a back surface; a pair of folded-back portions, provided on the front the back surfaces of the end portions of the base and folded back backward, or alternatively provided on the back surfaces of the end portions of the base and folded back forward; a pair of side walls, extending from the folded-back portions along a length of the end portions of the base; a pair of first locking pieces, extending downward from the side walls; and a linking portion adapted to link between the side walls. The base, the side walls, and the linking portion define a body containing portion.

20 Claims, 12 Drawing Sheets

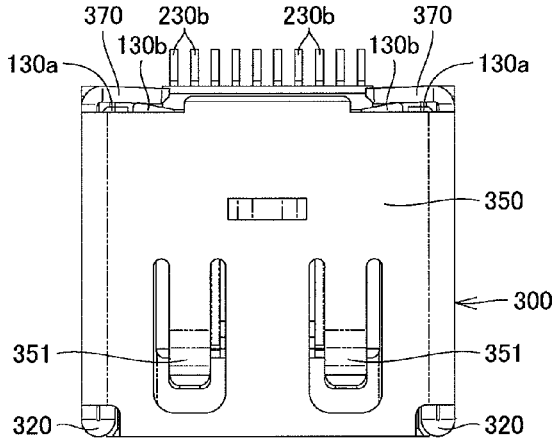
FIG. 2C
FIG. 2A
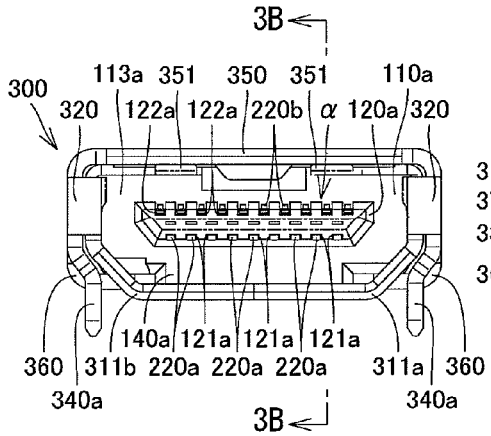
FIG. 2B
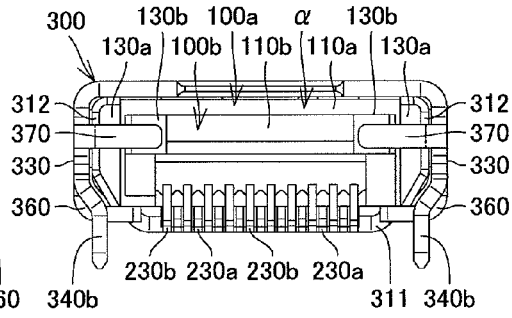
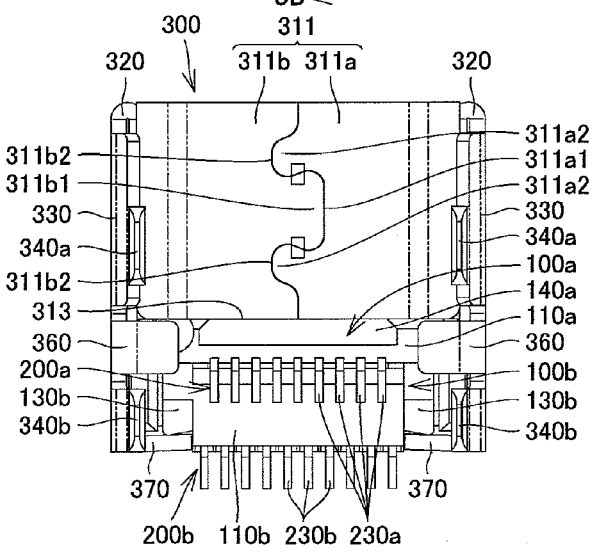
FIG. 2D

SHIELD CASE WITH U-SHAPED BASE WITH A FIRST PLATE AND SECOND PLATES AND SIDE WALLS PARALLEL TO SECOND PLATES

The present application claims priority under 35 U.S.C. §119 of Japanese Patent Application No. 2009-185114 filed on Aug. 7, 2009, the disclosure of which is expressly incorporated by reference herein in its entity.

BACKGROUND OF THE INVENTION

1. Technical Field

The present invention relates to a shield case to be mounted on a circuit board, a receptacle connector including the shield case, and an electronic equipment including the receptacle connector.

2. Background Art

A conventional receptacle connector of this type has a shield case as disclosed in paragraph 0024 and FIGS. 1 and 4 of Patent Literature 1 for the purpose of reducing the mounting height. More particularly, a bottom plate of the shield case having a generally O shape in front view is directly placed on a circuit board and is fixed onto the circuit board by engaging locking pieces of the shield case with locking holes of the circuit board. The locking pieces are formed by cutting out portions of the bottom plate of the shield case, resulting in holes formed in the cut-out portions of the bottom plate. The locking pieces also function as ground terminals in connecting the shield case to the circuit board by soldering. A problem with the conventional connector is that solder or flux enters the shield case through the holes when soldering the locking pieces to the circuit board, so that solder coagulates inside the shield case and hinders insertion of a plug into the shield case, or that the flux adheres to some receptacle contacts and thereby causes connection failure of the receptacle contacts with plug contacts.

The above problem may be solved in other conventional receptacle connectors such as ones disclosed in Patent Literatures 2 and 3. Particularly, the shield case has a body containing portion that contains a body of the connector, a pair of folded-back portions that is provided on front or back surfaces of end portions of the body containing portion and is folded back backward or forward, a pair of side walls that is provided continuously from the folded-back portions, and locking pieces extending downward from the side walls. In the shield case with the locking pieces provided in the side walls continuing from the folded-back portions, the bottom plate of the body containing portion have no holes that allow solder and flux to enter the body containing portion.

CITATION LIST

Patent Literature 1 JP-A-2007-149602
Patent Literature 2 JP-A-2007-220591
Patent Literature 3 JP-A-11-67365

SUMMARY OF INVENTION

Technical Problem

Unfortunately, the side walls of the above shield case are low in strength because they are plates continuing from the folded-back portions and extending along the ends of the body containing portion. The low strength causes a problem that when the plug is twisted inside the body containing portion, the side walls are apt to be inclined, thereby applying loads on the folded-back portions and on soldered portions between the locking pieces and the circuit board.

The present invention was devised in view of the foregoing circumstances. The present invention provides a shield case, a receptacle connector and electronic equipment that are capable of preventing solder and flux from entering a body containing portion during solder connection, and that have inclination-resistant side walls to reduce loads on folded-back portions and on soldered portions between locking pieces and a circuit board.

Solution to Problems

In order to solve the above problems, a shield case of the present invention includes a base of generally U-shape in front view having widthwise end portions, the end portions each having a front surface and a back surface; a pair of folded-back portions, provided on the front the back surfaces of the end portions of the base and folded back backward, or alternatively provided on the back surfaces of the end portions of the base and folded back forward; a pair of side walls, extending from the folded-back portions along a length of the end portions of the base; a pair of first locking pieces, extending downward from the side walls; and a linking portion adapted to link between the side walls. The base, the side walls, and the linking portion of the shield case define a body containing portion.

In the above shield case with the locking pieces provided in the side walls extending along the ends of the base, no hole is formed in the base. The shield case is thus advantageous in preventing the entry of solder and flux into the body containing portion when the base is set on a circuit board and the locking pieces are soldered to the circuit board. In addition, the side walls linked by the linking portion are resistant to inclination and/or skew if the plug is twisted inside the body containing portion. Consequently, the shield case can advantageously reduce load applied on the folded-back portions and on the solder-connected portions between the locking pieces and the circuit board due to the inclination and/or skew of the side walls.

The shield case may further include a top plate for connecting the end portions of the base. The top plate and the base together have a generally O-shape in front view.

The first locking pieces may be provided on lower ends of the side walls. The linking portion may link between upper ends of the side walls.

If the body containing portion is adapted to contain a body, and if the body has an abutting surface on which a distal end surface of a plug is abuttable, the first locking pieces may be disposed forward of the abutting surface of the body contained in the body containing portion. When a plug is twisted inside the body containing portion, with a cable connected to the plug acting as an application point of effort, loads will be applied to the shield case, with the distal end of the plug acting as a fulcrum. To address this possibility, the first locking pieces in this aspect of the invention are disposed forward of the abutting surface of the body on which the distal end surface of the plug is to abut (i.e., on the point of effort side with respect to the fulcrum), loads applied on the first locking pieces can be reduced as compared with a case where the locking pieces are disposed backward of the abutting surface (i.e., backward of the fulcrum). Consequently, the invention is advantageous in preventing detachment of the shield case or a connector having the shield case from the circuit board, and also in preventing deformation or damage of the shield case and the connector.

The shield case can be configured to further include a pair of second locking pieces extending downward from the lower ends of the side walls. The shield case should thus be more securely fixed to the circuit board by soldering the first and second locking pieces to the circuit board.

If the body containing portion is adapted to contain a body, the side walls and the linking portion may be larger in length than the base. The side walls may have non-facing regions at lower ends thereof, the non-facing regions not facing the base. The shield case may further include a pair of holders provided in the respective non-facing regions. A distance between the holders and the linking portion may substantially the same as a height dimension of the body, so that a lower surface of the body is abuttable on the holders and an upper surface of the body is abuttable on the linking portion. In this case, once the body is contained in the body containing portion, the lower surface of the body abuts on the holders and the upper surface of the body abuts on the linking portion to fix the body, so that the body can be held in the body containing portion with high accuracy.

The base or the linking portion may have a first piece provided with a recess and a second piece provided with a protrusion. The first and second pieces may be caulked in a state where the protrusion is fitted into the recess.

A receptacle connector of the present invention includes the shield case as described above, a body contained in the body containing portion of the shield case, and a plurality of first contacts disposed in the body, the first contacts being arranged in a row in a width direction of the receptacle connector.

The receptacle connector may include a plurality of second contacts disposed in the body. The second contacts may be arranged in a different row from the row of the first contacts, in the width direction of the receptacle connector.

The body may have first and second bodies combined in a fore-and-aft direction. In this case, the first contacts may be buried in the first body. The second contacts may be buried in the second body and arranged at a different height position from a height position of the first contacts in a state where the first and second bodies are combined. The first and second contacts as such are buried in the first and second bodies, respectively, so that the connector can be downsized maintaining enough thickness of the first and second bodies to hold the first and second contacts. In addition, the first and second contacts insert-molded into the first and second bodies are less likely to distortion compared to a case where the contacts are press-fitted into the bodies. The first and second contacts are also advantageous in reducing the pitch variation therebetween due to distortion. Moreover, in a case where distal end portions of the first and second contacts are bent in directions close to one another, if the first and second contacts were buried in one body, the distance between the distal end portions of the first and second contacts would be too small to ensure pressure-resistance. In contrast, the connector of the invention has the first contacts buried in the first body and the second contacts buried in the second body, so that it is possible to allot enough distances between the distal end portions of the first and second contacts to ensure the pressure resistance.

If the base of the shield case is smaller in length than the linking portion, and if a back surface of the base functions as an abutting stop surface on which the first body abuts, the back surfaces of the side walls or the back surface of the linking portion of the shield case may be provided with a lock piece, and the first and second bodies may be sandwiched between the abutting stop surface and the lock piece. Such receptacle connector is advantageous in securing the first and second bodies in position inside the body containing portion of the shield case and in securing the first and second contacts in position. The secure positioning can be made simply by inserting the combined first and second bodies into the body containing portion of the shield case and bringing the first body into abutment against the back surface of the base, and then bending the lock piece provided on the back surfaces of the side walls or on the back surface of the linking portion in such a manner as to abut the back surface of the second body. The first and second contacts are stably positioned with high accuracy because the first and second bodies are less likely to move inside the shield case so as to deteriorate position accuracy of the first and second contacts.

Alternatively, if the linking portion of the shield case is smaller in length than the base, and if a back surface of the linking portion functions as an abutting stop surface on which the first body abuts, the back surfaces of the side walls or the back surface of the base of the shield case may be provided with a lock piece, and the first and second bodies may be sandwiched between the abutting stop surface and the lock piece. Such receptacle connector is also advantageous in securing the first and second bodies in position inside the body containing portion of the shield case and in securing the first and second contacts in position. The secure positioning can be made simply by inserting the combined first and second bodies into the body containing portion of the shield case and bringing the first body into abutment against the back surface of the linking portion, and then bending the lock piece provided on the back surfaces of the side walls or on the back surface of the base in such a manner as to abut the back surface of the second body. The first and second contacts are stably positioned with high accuracy because the first and second bodies are less likely to move inside the shield case so as to deteriorate position accuracy of the first and second contacts.

The first body may have a fitting protrusion in a surface thereof facing the second body and the second body may have a fitting recess in a surface thereof facing the first body. Alternatively, the first body may have a fitting recess in a surface thereof facing the second body and the second body may have a fitting protrusion in a surface thereof facing the first body. In either case, the fitting protrusion may fit into the fitting recess when the first and second bodies are combined. Simply by fitting the fitting protrusion into the fitting recess, the first and second bodies can be securely combined in position, and the first and second contacts can also be secured in position, in the arrangement of two rows. Consequently, the receptacle connector in this aspect of the invention is advantageously improved in positioning the first and second contacts stably and accurately.

The first body may include: a main body of a generally rectangular shape in cross-sectional view having a front surface that functions as an abutting surface on which a distal end surface of a plug is abuttable; a projected portion, projected from the front surface of the main body; and a protruded portion, provided on a lower surface of the main body and abuttable on the abutting stop surface. The projected portion may have first and second surfaces in a thickness direction thereof, the first and second surfaces being provided with first long grooves and second long grooves, respectively, extending in the fore-and-aft direction. The main body may further have holes communicating with the second long grooves. Each of the second contacts may have: a second buried portion buried in the second body; a second contact portion continued from a lengthwise end of the second buried portion and received in one of the holes and one of the second long grooves; and a second tail portion continued from the other lengthwise end of the second buried portion. Each of the first contacts may have: a first buried portion buried in the main body of the first body; a first contact portion continued from a lengthwise end of the first buried portion and received in one of the first long grooves of the projected portion; and a first tail portion continued from the other lengthwise end of the first buried portion and disposed near the protruded portion.

In this aspect of the invention, the protruded portion located near the first tail portions abuts the abutting stop surface and is thereby fixed in position, so that the first and second tail portions, which are portions to be mounted on a circuit board, can be fixed with a highly accurate mounting pitch and coplanarity. In addition, it is advantageously easy to position the second contact portions of the second contacts, simply by inserting the second contact portions of the second contacts into the holes and the second long grooves of the first body.

A distance between the base and the linking portion may be substantially the same as a height dimension of the main body. A lower surface of the main body may abut the base, and an upper surface of the main body may abut the linking portion. In this aspect of the invention, with the first body contained in the body containing portion, the lower surface of the main body of the first body abuts the base and the upper surface of the main body abuts the linking portion to fix the first body, further improving positioning accuracy of the combined first and second bodies. Accordingly, the position accuracy of the first and second contacts is also further improved.

The first and second tail portions may be arranged in two rows in the fore-and-aft direction. The first and second tail portions in two rows are connectable by soldering to first and second electrodes disposed in two rows in the fore-and-aft direction in the circuit board. Moreover, the first and second tail portions may be hung downward. Such first and second tail portions are connectable by soldering into first and second through-holes formed in two rows in the fore-and-aft direction in the circuit board.

Alternatively, the first and second tail portions may be aligned in a row if the first and second contacts are arranged in a zigzag manner. The first and second tail portions in a row are connectable to the first and second electrodes disposed in a row in the circuit board. Moreover, the first and second tail portions may be hung downward. Such first and second tail portions are connectable by soldering them into the first and second through-holes formed in a row in the circuit board.

An electronic equipment of the present invention may be provided with the receptacle connector as described above as an external interface.

BRIEF DESCRIPTION OF DRAWINGS

FIGS. 2A to 2D are schematic views of the connector, FIG. 2A being a front view, FIG. 2B being a back view, FIG. 2C being a plan view, and FIG. 2D being a bottom view.

FIG. 5A is a view seen obliquely from the bottom right back side, and FIG. 5B is a view seen obliquely from the top right back side.

FIG. 12A is a bottom view showing a state where the first and second tail portions are disposed in a row, and FIG. 12B is a cross-sectional view showing a state where the first and second tail portions extend downward to be connected into first and second through-holes of the circuit board.

DESCRIPTION OF EMBODIMENTS

Hereinafter, a receptacle connector according to an embodiment of the present invention is described with reference to FIGS. 1A to 9. The receptacle connector shown in FIGS. 1A to 3B is compliant with the HDMI (High-Definition Multimedia Interface) standard, to be mounted on a circuit board 10 of an electronic equipment, such as a television receiver, and used as an external interface of the electronic equipment. The receptacle connector includes first and second bodies 100*a*, 100*b*, a plurality of first and second contacts 200*a*, 200*b*, and a shield case 300. The respective elements of the connector will be described in detail below.

Figure 3A:
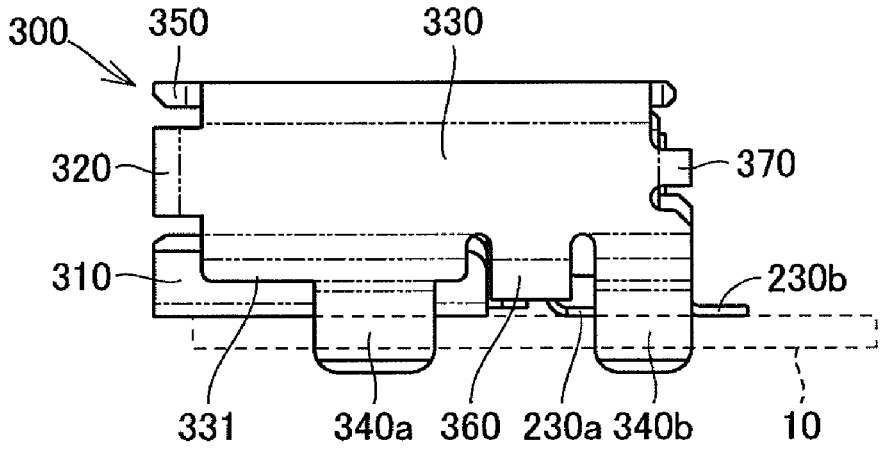
FIGS. 3A and 3B are schematic views of the connector mounted on a circuit board, FIG. 3A being a side view, and FIG. 3B being a cross-sectional view taken along line 3-3 in FIG. 2A.
Figure 3B:
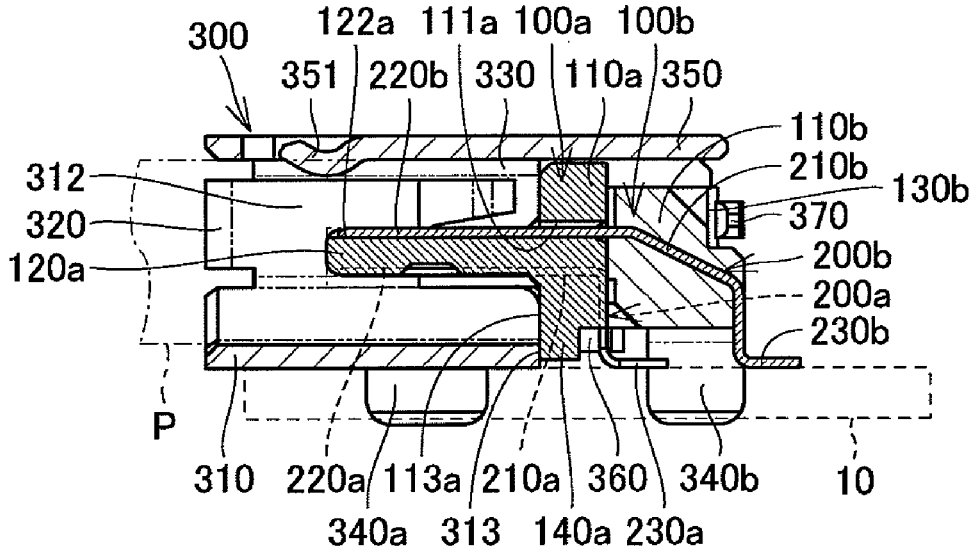
Figure 4:
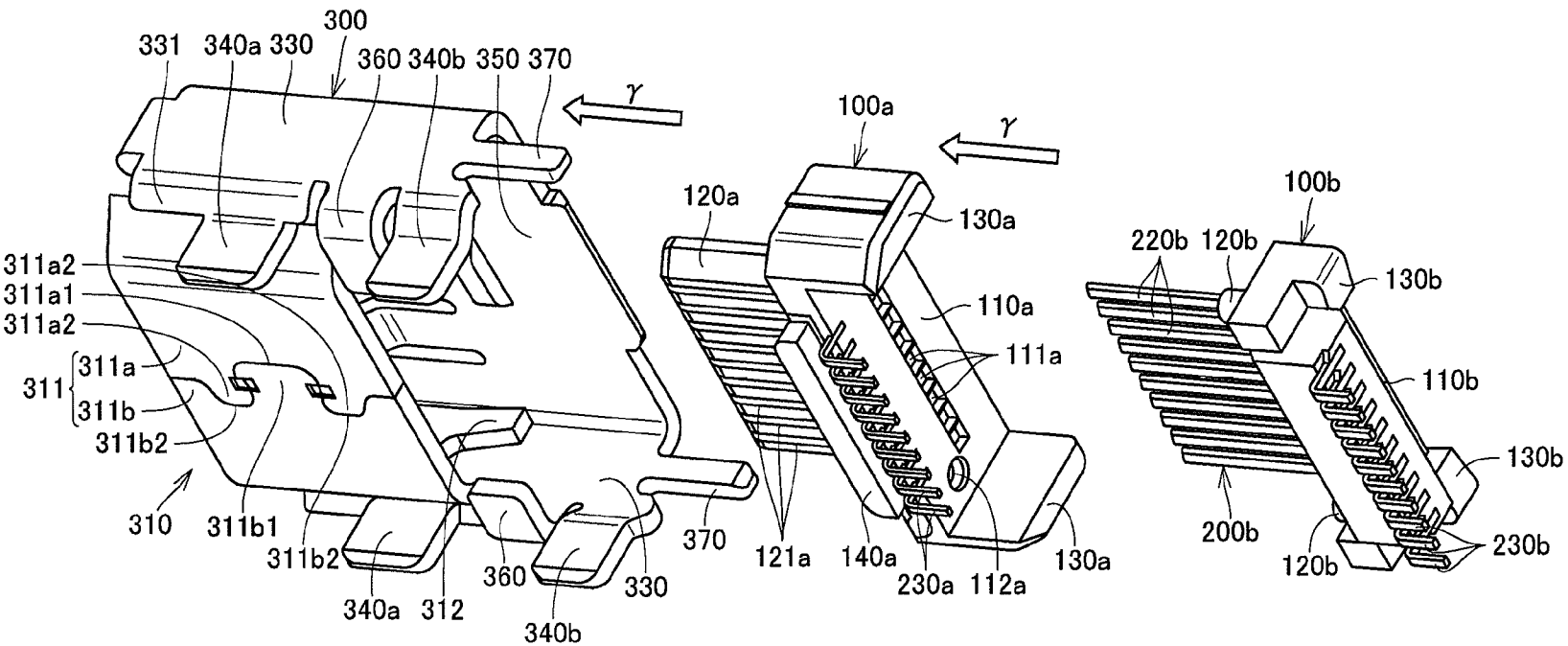
FIG. 4 is a schematic exploded perspective view of the connector.

The first body 100*a* is a molded article of insulating resin, as shown in FIGS. 1B to 6B. The first body 100*a* has a main body 110*a*, a projected portion 120*a*, a pair of walls 130*a*, and an elongated protrusion 140*a* (protruded portion). The main body 110*a* is a plate-like body having a generally rectangular shape in cross-sectional view. A plurality of generally rectangular holes 111*a* are formed in the middle of the main body 110*a*, spaced from one another and aligned in the width direction of the main body 110*a*, as shown in FIGS. 3B, 4 and 6A. The holes 111*a* penetrate the main body 110*a* in a fore-and-aft direction γ. Below the holes 111*a* in the main body 110*a*, the first contacts 200*a* are disposed in a row, spaced from one another in the width direction. The first contacts 200*a* are arranged with the phase shifted from the holes 111*a*, as shown in FIG. 6A. In other words, each of the first contacts 200*a* is arranged between respective two adjacent holes 111*a* in plan position. Moreover, circular fitting recesses 112*a* are provided in a back surface (surface facing the second body) of the main body 110*a*, one at either side of the holes 111*a*. The walls 130*a* are generally rectangular and extend backward from opposite widthwise ends of the main body 110*a*.

Figure 5A:
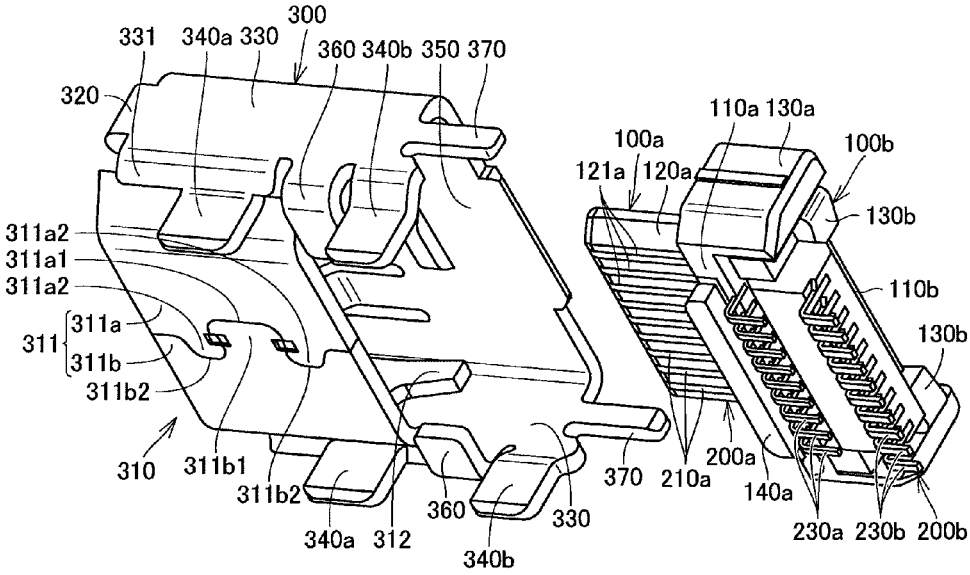
FIGS. 5A and 5B are schematic perspective views of the connector, illustrating a state where its first and second bodies are combined but yet to be contained in a shield case.
Figure 6A:
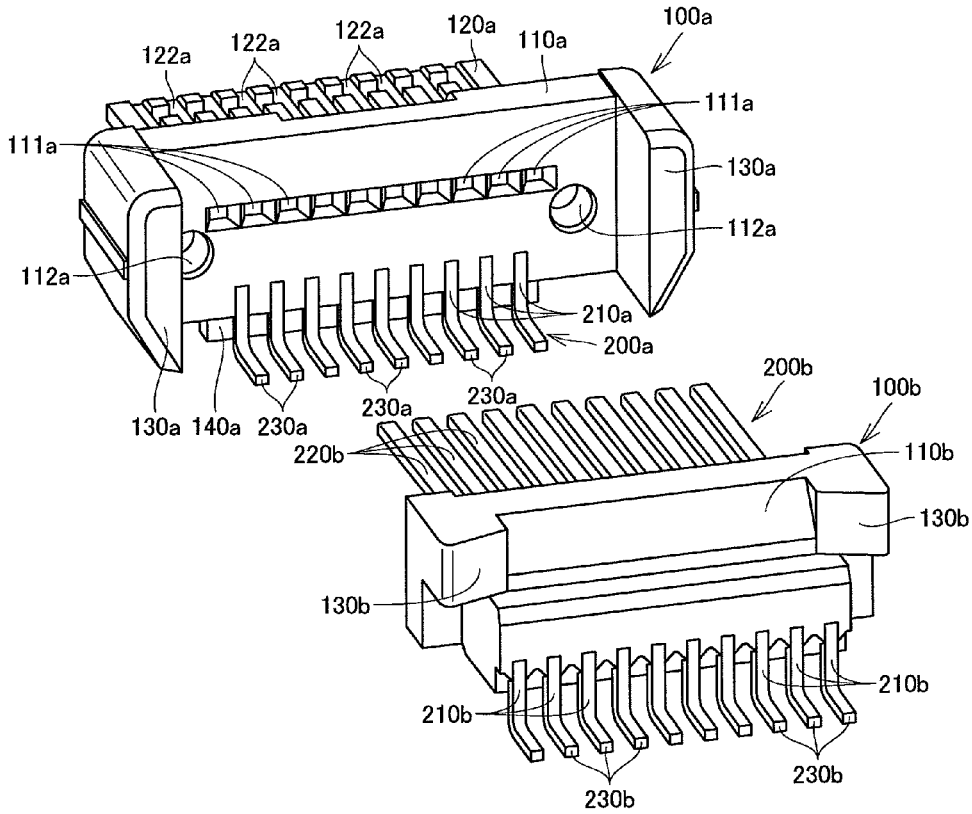
FIGS. 6A and 6B are schematic views of the first and second bodies of the connector, illustrating a state before they are combined, FIG. 6A being a view seen obliquely from the upper right back side, and FIG. 6B being a plan view.
Figure 6B:
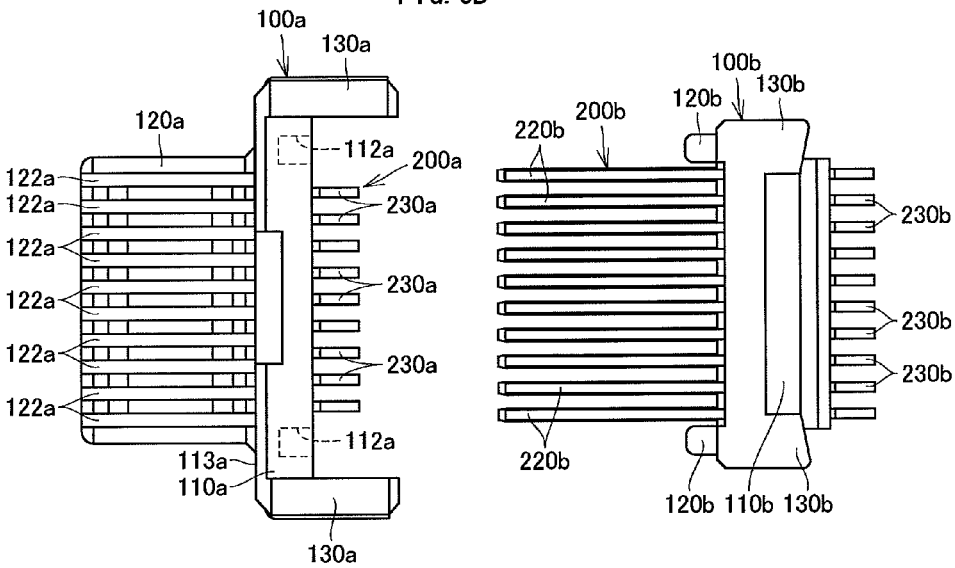

A front surface 113*a* of the main body 110*a* forms an abutting surface on which a mating plug P is abuttable, as shown in FIG. 3B. The projected portion 120*a* is provided below the holes 111*a* on the front surface 113*a* of the main body 110*a*. The projected portion 120*a* is a plate-like body extending toward the front of the connector. The lower surface of the projected portion 120*a* (first surface in a thickness direction) is provided with a plurality of first long grooves 121*a*, as shown in FIGS. 4 and 5A. The upper surface (second surface in the thickness direction) of the projected portion 120*a* is provided with a plurality of second long grooves 122*a*, as shown in FIGS. 6A and 6B. The first and second long grooves 121*a*, 122*a* are arranged in a zigzag manner in front view as shown in FIG. 2A. The first long grooves 121*a* corresponds in pitch distance to the first contacts 200*a*. The first long grooves 121*a* receive first contact portions 220*a* (to be described) of the first contacts 200*a*. The second long grooves 122*a* correspond in pitch distance to the holes 111*a* and communicate with the holes 111*a*, as shown in FIG. 3B. The lower surface of the main body 110*a* is provided with the elongated protrusion 140*a* of a generally rectangular shape in cross-sectional view, as shown in FIGS. 2D, 3B, 4 and 5A. The elongated protrusion 140*a* is located in a front-side vicinity of first tail portions 230*a* (to be described) of the first contacts 200*a*.

The first contacts 200*a* are elongated metal plates having electrical conductivity. As shown in FIG. 3B, the first contacts 200*a* each have a first buried portion 210*a* of a generally downward L-shape, a first contact portion 220*a* in flat plate form continuing from the distal end (one end in the length direction) of the first buried portion 210*a*, and a first tail portion 230*a* in flat plate form continuing from the rear end (the other end in the length direction) of the first buried portion 210*a*. The first buried portion 210*a* except its rear end is buried in the main body 110*a*. The rear end of the first buried portion 210*a* sticks out downward from the main body 110*a*. The first contact portion 220*a* sticks out from the main body 110*a* and is inserted into one of the first long grooves 121*a* of the projected portion 120*a*. The first tail portion 230*a* is bent at a substantially right angle with respect to the rear end of the first buried portion 210*a*. The first tail portion 230*a* is connected by soldering with one of first electrodes 11*a* of the circuit board 10 shown in FIG. 9.

The second body 100*b* is a molded article of insulating resin as shown in FIGS. 1B to 6B. The second body 100*b* has a main body 110*b*, a pair of fitting protrusions 120*b*, and a pair of hills 130*b*. The main body 110*b*, as shown in FIGS. 2B, 5A and 5B, has a generally L-shape in cross-sectional view and has a width slightly smaller than a distance between the pair of walls 130*a* of the first body 100*a*. That is, the main body 110*b* is adapted to be held between the walls 130*a*. As shown in FIG. 6B, the pair of fitting protrusions 120*b* is provided at opposite widthwise ends of a front surface (surface facing the first body) of the main body 110*b*. These fitting projections 120*b* are columnar projections adapted to be fitted into the fitting recesses 112*a* of the first body 100*a*. By fitting the fitting projections 120*b* into the fitting recesses 112*a*, the first and second bodies 100*a*, 100*b* are securely combined in the fore-and-aft direction γ of the connector. The main body 110*b* holds the second contacts 200*b* that are arranged in a row and in spaced relation to one another in the width direction. The second contacts 200*b* are arranged in such a manner that their second contact portions 220*b* (to be described) correspond in position to the holes 111*a* of the first body 100*a*. That is, in the state where the first and second bodies 100*a*, 100*b* are combined in the fore-and-aft direction γ, the second contact portions 220*b* of the second contacts 200*b* are received in the holes 111*a* and the second long grooves 122*a* of the first body 100*a*, so that the first and second contact portions 220*a*, 220*b* of the first and second contacts 200*a*, 200*b* are arranged at different heights in two rows to form a zigzag arrangement. The pair of hills 130*b* is provided at opposite widthwise ends of a back surface of the main body 110*b*. As shown in FIG. 2D, distal ends of the hills 130*b* project backward further than the walls 130*a* in the state where the first and second bodies 100*a*, 100*b* are combined in the fore-and-aft direction γ of the connector.

The second contacts 200*b* are elongated metal plates having electrical conductivity. As shown in FIG. 3B, the second contacts 200*b* each have a second buried portion 210*b*, a second contact portion 220*b* continuing from the distal end (one end in a length direction) of the second buried portion 210*b*, and a second tail portion 230*b* continuing from the rear end (the other end in the length direction) of the second buried portion 210*b*. The second buried portion 210*b* has an intermediate portion inclined obliquely, and a distal end portion bent relative to the intermediate portion, and a back end portion bent relative to the intermediate portion and hanging downward. The distal end portion and the intermediate portion of the second buried portion 210*b* are buried in the main body 110*b*. The rear end portion of the second buried portion 210*b* sticks out downward from the main body 110*b*. The second contact portion 220*b* is a flat plate longer than the first contact portion 220*a* and sticks out from the front surface of the main body 110*b*. The second contact portion 220*b* is received in one of the holes 111*a* and the communicating one of the second long grooves 122*a* of the first body 100*a*, as described above. The second tail portion 230*b* is a flat plate bent at a substantially right angle with respect to the rear end portion of the second buried portion 210*b*. The second tail portion 230*b* is connected by soldering with one of second electrodes 11*b* of the circuit board 10 shown in FIG. 9. A lower surface of the second tail portion 230*b* is set at the same height position as that of a lower surface of the first tail portion 230*a* in the state where the first and second bodies 100*a*, 100*b* are combined. That is, with the first and second bodies 100*a*, 100*b* combined, the first tail portions 230*a* and the second tail portions 230*b* are arranged in two rows—as front and back rows, respectively—at the same height position.

The shield case 300 is fabricated by press-molding a metal plate having electrical conductivity, as shown in FIGS. 1A to 8B. The shield case 300 has a base 310 of generally U-shape in front view, a pair of folded-back portions 320, a pair of side walls 330, pairs of first and second locking pieces 340*a*, 340*b*, a linking plate 350 (linking portion), a pair of holders 360, and a pair of lock pieces 370.

Figure 8A:
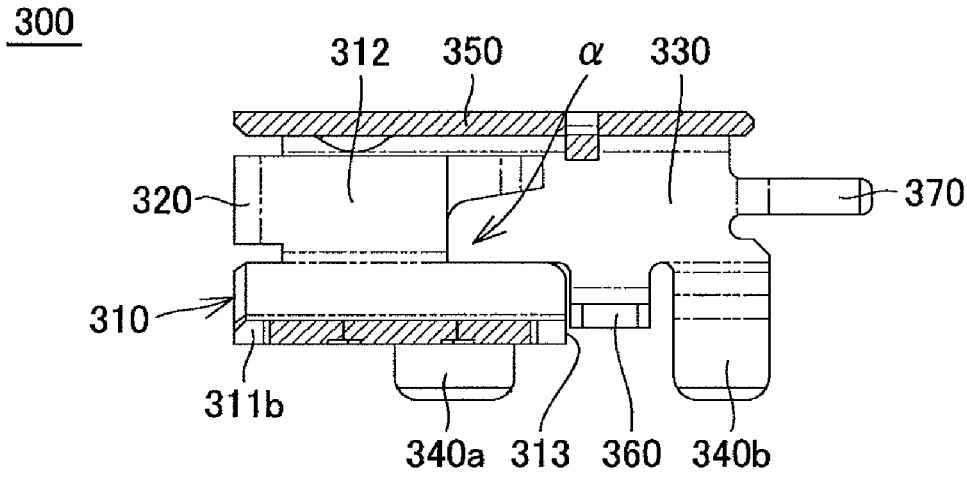
FIGS. 8A and 8B are schematic cross-sectional views of the shield case, FIG. 8A being a cross-sectional view taken along line 8A-8A in FIG. 7A, and FIG. 8B being a cross-sectional view taken along line 8B-8B in FIG. 7A.
Figure 8B:
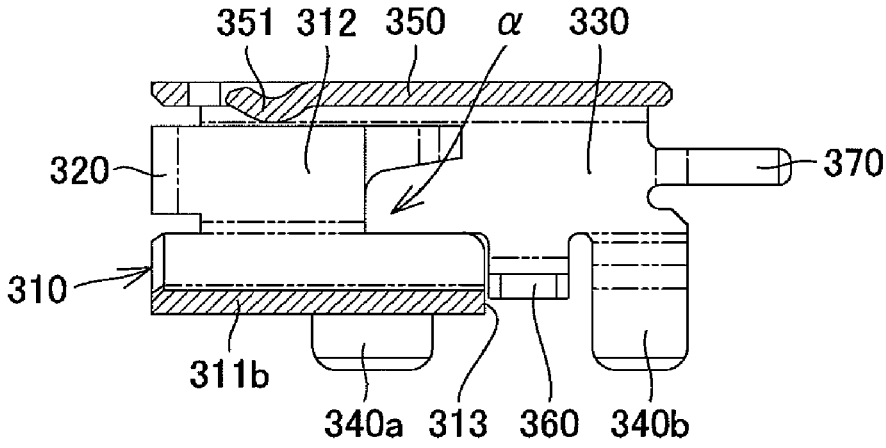
Figure 9:
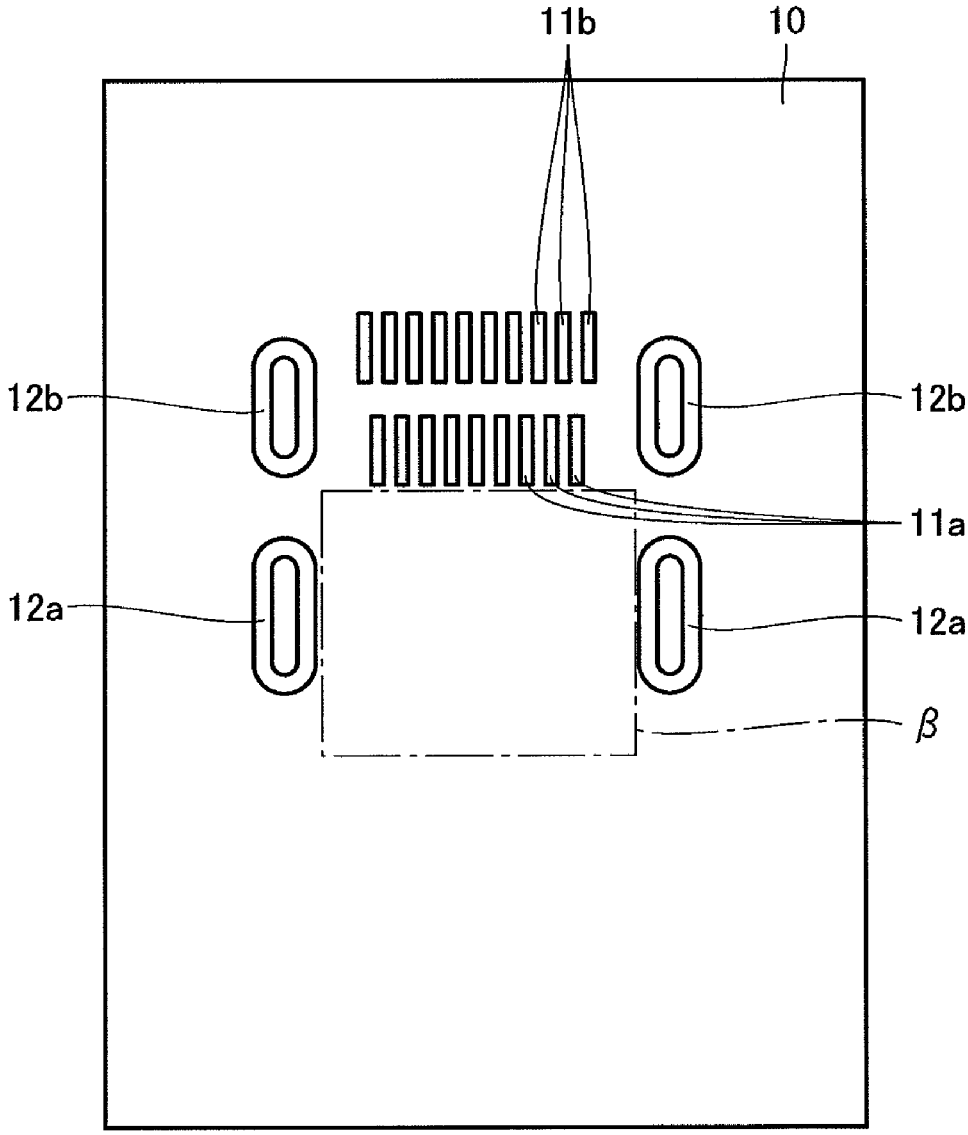
FIG. 9 is a schematic plan view of the circuit board for mounting the connector.

The base 310 has a base body 311, which is a plate of generally U-shape in front view, and a pair of extended portions 312 (widthwise end portions). The base body 311 is divided in the width direction into two pieces, one of which a first piece 311*a* and the other is a second piece 311*b*. The first piece 311*a* has a first recess 311*a*1 and a pair of first protrusions 311*a*2 on either side of the first recess. The second piece 311*b* has a second protrusion 311*b*1 and a pair of second recesses 311*b*2 on either side of the second protrusion. The second protrusion 311*b*1 is fitted in the first recess 311*a*1, and the first protrusions 311*a*2 are fitted in the second recesses 311*b*2. The first and second pieces 311*a*, 311*b* are then caulked and joined together. The extended portions 312 are plates of generally downward L-shape, extending from the outer ends of the base body 311, as shown in FIGS. 8A and 8B. The front surfaces of the extended portions 312 are continued to the folded-back portions 320.

Figure 7C:
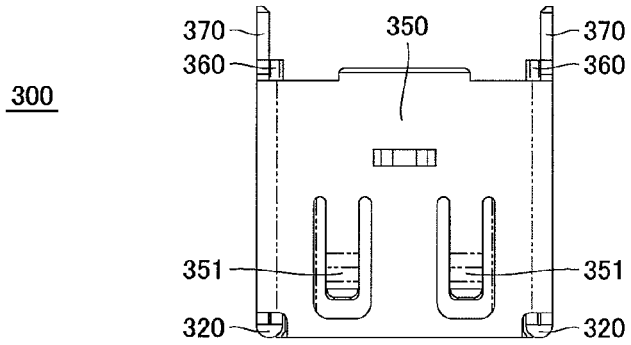
FIGS. 7A to 7E are schematic views showing the shield case of the connector, FIG. 7A being a front view, FIG. 7B being a back view, FIG. 7C being a plane view, FIG. 7D being a bottom view, and FIG. 7E being a side view.
Figure 7E:
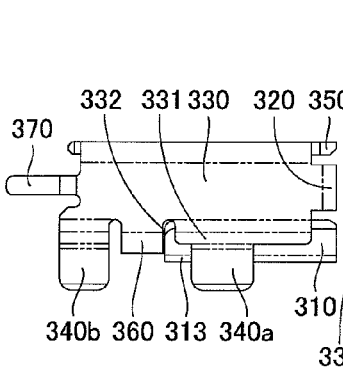
Figure 7A:
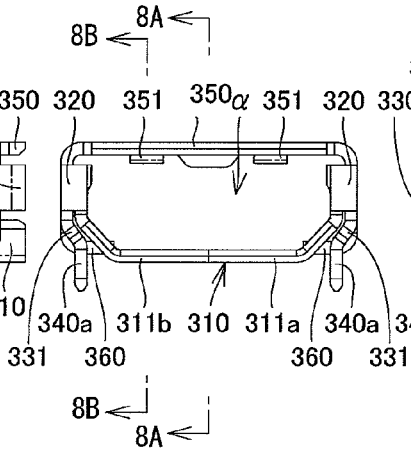
Figure 7B:
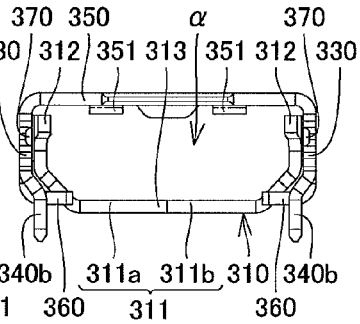
Figure 7D:
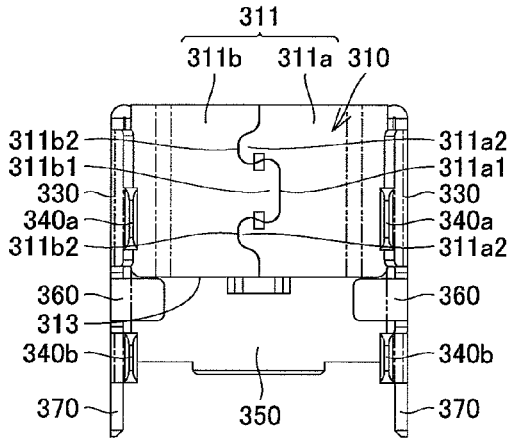

The folded-back portions 320 are plates of generally U-shape in plan view that are folded back backward. The rear ends of the folded-back portions 320 are continued to the side walls 330. The side walls 330 are generally rectangular plates extending backward along the extended portions 312, and they are longer than the base 310. As shown in FIGS. 7A and 7E, a lower end portion of each of the side walls 330 is divided by an incision 332 into a portion facing the base body 311 (referred to hereinafter as an facing portion 331) and a portion not facing the base body 311 (referred to hereinafter as an non-facing portion). The facing portions 331 are bent so as to incline toward the base body 311. Upper ends of the side walls 330 are linked by the linking plate 350. The linking plate 350 is a generally rectangular plate having a substantially same length dimension as those of the side walls 330. That is, the length dimension of the linking plate 350 is larger than that of the base 310. The base 310, the side walls 330 and the linking plate 350 define a body containing space α (body containing portion). The body containing space α receives and contains the first and second bodies 100*a*, 100*b* combined in the fore-and-aft direction γ as described above, from the back side of the shield case 300.

As shown in FIG. 3B, back surfaces of the first and second pieces 311*a*, 311*b* of the base 310 function as an abutting stop surface 313. When the first body 100*a* is contained in the body containing space α, the front surface of the elongated protrusion 140*a* of the first body 100*a* abuts the abutting stop surface 313 abuts and stops. The back surfaces of the side walls 330 are provided with the lock pieces 370. The lock pieces 370 are bent at a substantially right angle with respect to the side walls 330 to abut against the pair of hills 130*b* of the second body 100*b* contained in the body containing space α. That is, the first and second bodies 100*a*, 100*b* are sandwiched and fixed between the lock pieces 370 and the abutting stop surface 313. FIGS. 4, 5A, 5B, 7A to 7E, 8A, and 8B illustrate the lock pieces 370 in a pre-bend state.

Figure 1A:
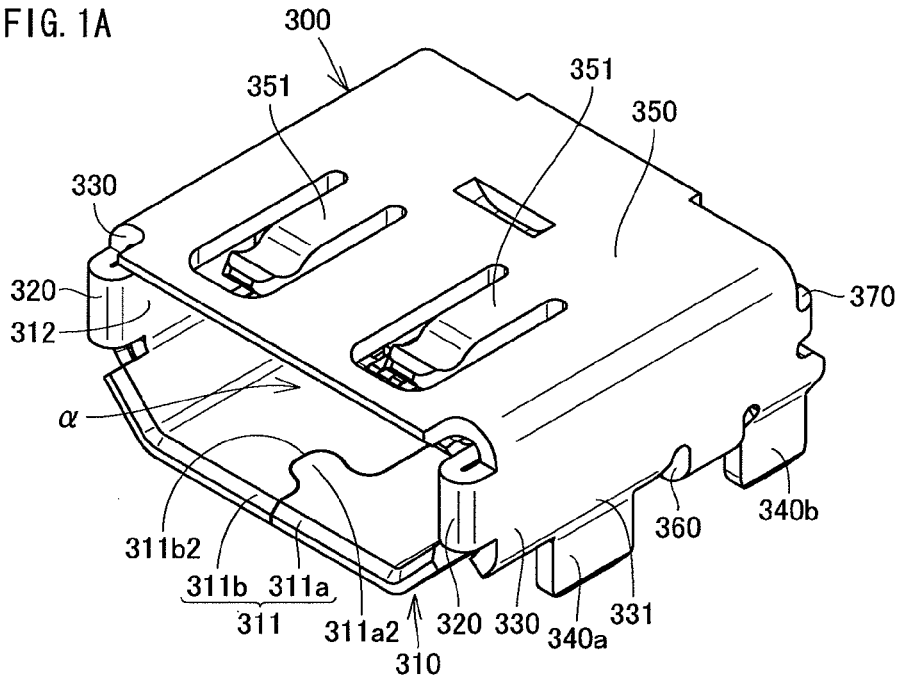
FIGS. 1A and 1B are schematic perspective views of a receptacle connector according to an embodiment of the present invention, FIG. 1A being a view seen obliquely from upper right, and FIG. 1B being a view seen obliquely from lower right.
Figure 5B:
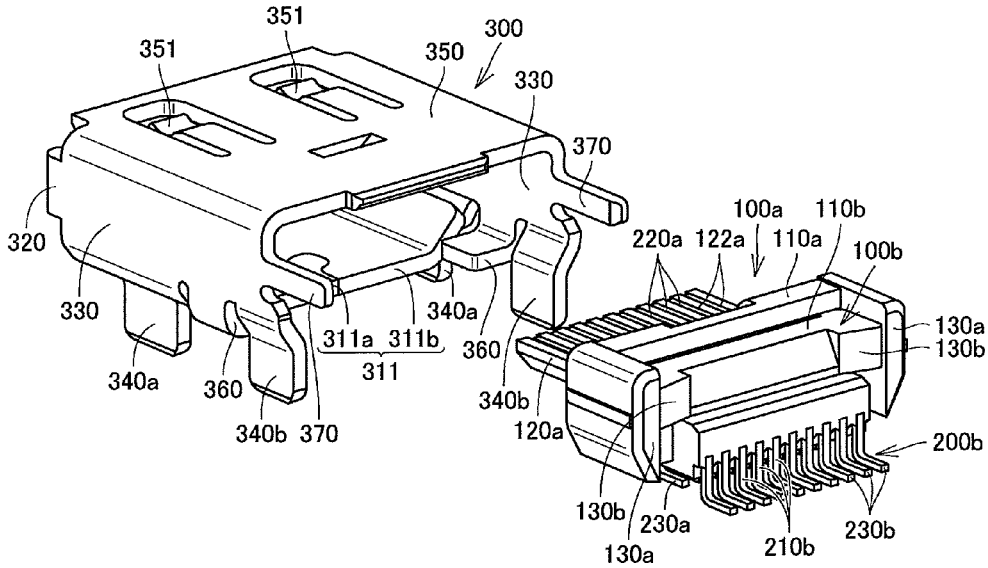

As shown in FIG. 3B, in the body containing space α, space defined by the base 310, the linking plate 350, and the front surface 113*a* of the main body 110*a* of the first body 100*a* functions as a plug receiving hole to receive the plug P. As shown in FIGS. 1A, 2C and 5B, the linking plate 350 is provided with a pair of lock arms 351 formed by cutting out portions of the linking plate 350. Distal end portions of the lock arms 351 are bent downward in a generally U-shape, and apexes of the distal end portions are located inside the body containing space α. As such, when the plug P is inserted into the body containing space α, the apexes of the lock arms 351 come into elastic contact with the plug P to hold the plug P.

In the side walls 330, lower ends of the facing portions 331 facing the base 310 are provided with the first locking pieces 340*a* extending downward (in the direction perpendicular to the length direction and the width direction of the side walls 330), while lower ends of the non-facing portions are provided with the holders 360 and the second locking pieces 340*b*, both extending downward. The first and second locking pieces 340*a*, 340*b* are to be inserted for soldering into first and second locking holes 12*a*, 12*b* of the circuit board 10 shown in FIG. 9. The first and second locking holes 12*a*, 12*b* are through-hole electrodes connected to a ground layer of the circuit board 10. As shown in FIG. 2B, the first locking pieces 340*a* are arranged forward of the front surface 113*a* of the main body 110*a* of the first body 100*a* contained in the body containing space α. This arrangement is designed assuming a case where a user twists the plug P (i.e. turns it in a circumferential direction) received in the plug receiving hole of the body containing space α. In this case, a cable (not shown) connected to the plug P acts as an application point of effort, a distal end of the plug P acts as a fulcrum, and loads are applied to the shield case 300. However, the first locking pieces 340*a* are disposed forward of the front surface 113*a* (abutting surface) of the main body 110*a* on which the distal end of the plug abuts (i.e., on the point of effort side with respect to the fulcrum), loads applied on the first locking pieces 340*a* should be reduced as compared with a case where the first locking pieces 340*a* are disposed backward of the abutting surface (i.e., backward of the fulcrum). The first locking pieces 340*a* thus arranged can prevent detachment of the connector from the circuit board 10 and also prevent deformation or damage of the connector.

Figure 1B:
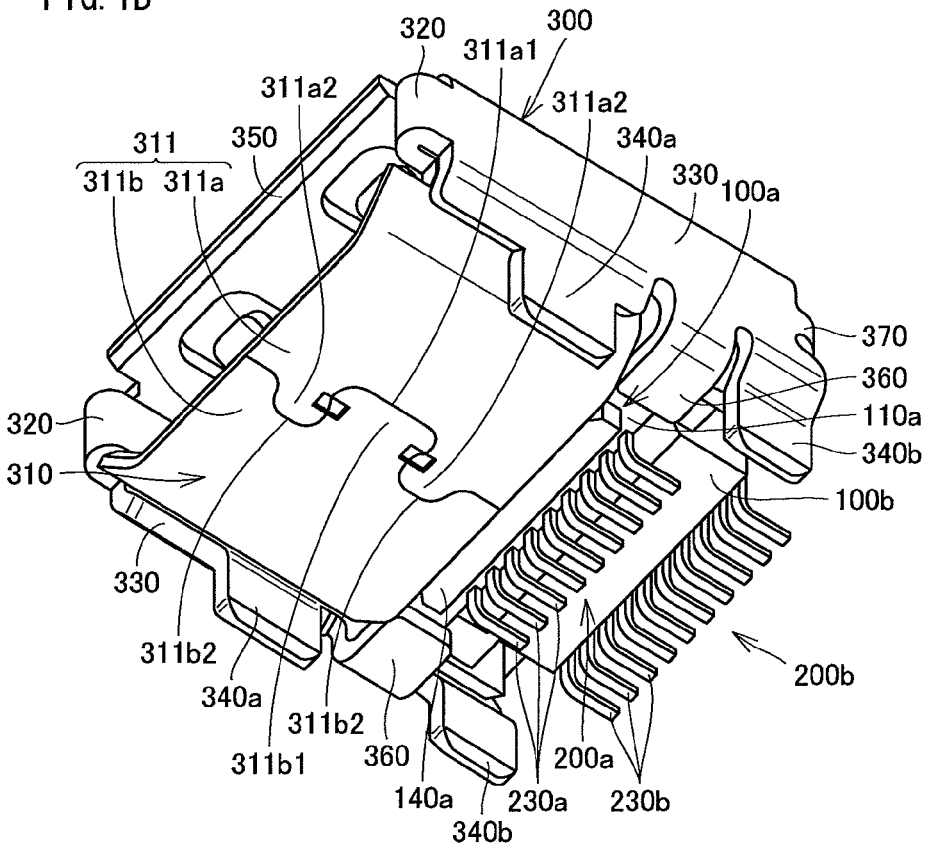

The holders 360 are L-shaped plates arranged between the first locking pieces 340*a* and the second locking pieces 340*b*. As shown in FIGS. 1B, 2B, and 2D, the holders 360 hold portions outside the elongated protrusion 140*a* of the main body 110*a* of the first body 100*a* contained in the body containing space α. As shown in FIG. 3B, a distance between the holders 360 and the linking plate 350 is substantially the same as a height dimension of the main body 110*a* of the first body 100*a*. This allows an upper surface of the main body 110*a* to abut on the linking plate 350 in a state where the main body 110*a* is held by the holders 360. Moreover, a distance between the side walls 330 is substantially the same as a distance between outer surfaces of the walls 130*a* of the first body 100*a*. This allows the outer surfaces of the walls 130*a* to abut on inner surfaces of the side walls 330 in a state where the first body 100*a* is contained in the body containing space α.

Hereinafter, an assembling procedure of the receptacle connector configured as described above will be described. First, the first body 100*a* with the first buried portions 210*a* of the first contacts 200*a* buried therein by insert molding, and the second body 100*b* with the second buried portions 210*b* of the second contacts 200*b* buried therein by insert molding are prepared. The second contact portions 220 of the second contacts 200*b* are aligned and inserted into the holes 111*a* of the first bodies 100*a* as shown in FIGS. 4 and 6A.

Thereafter, the first body 100*a* and the second body 100*b* are brought relatively close to each other, and the fitting projections 120*b* of the second body 100*b* are fitted into the fitting recesses 112*a* of the first body 100*a*. At this time, the second contact portions 220*b* advances inside the holes 111*a* of the first body 100*a* and enters the second long grooves 122*a* of the first body 100*a*. This results in the first and second contact portions 220*a*, 220*b* to be arranged at different height positions in two (upper and lower) rows in a zigzag manner. At the same time, the first and second tail portions 230*a*, 230*b* are arranged at the same height in two front and back lines. The first body 100*a* and the second body 100*b* are thus combined in the fore-and-aft direction γ.

The combined first and second bodies 100*a*, 100*b* are then inserted into the body containing space α of the shield case 300 from behind as shown in FIGS. 5A and 5B, and the front surface of the elongated protrusion 140*a* of the first body 100*a* is brought into abutment with the abutting stop surface 313 of the base 310 of the shield case 300. At the same time, the portions outside the elongated protrusion 140*a* of the main body 110*a* of the first body 100*a* are placed on the holders 360. On the other hand, the upper surface of the main body 110*a* abuts the linking plate 350, and the walls 130*a* abut the inner surfaces of the side walls 330.

Thereafter, the lock pieces 370 are bent so as to abut the respective hills 130*b* of the second body 100*b*. As a result, the first and second bodies 100*a*, 100*b* are sandwiched between the abutting stop surface 313 of the base 310 and the lock pieces 370, and the first and second contact portions 220*a*, 220*b* and the first and second tail portions 230*a*, 230*b* are securely disposed in the above-described arrangement. In this way the receptacle connector is assembled.

The assembled receptacle connector is mounted on the circuit board 10 in the following steps. First, the first and second locking pieces 340*a*, 340*b* of the shield case 300 are inserted into the first and second locking holes 12*a*, 12*b* of the circuit board 10 to set the base 310 of the shield case 300 in a setting region β shown in FIG. 9 of the circuit board 10. When the receptacle connector is set in place, the first and second tail portions 230*a*, 230*b* of the first and second contacts 200*a*, 200*b* are placed on top of the first and second electrodes 11*a*, 11*b*, respectively, of the circuit board 10. The first and second locking pieces 340*a*, 340*b* are then connected by soldering to the first and second locking holes 12*a*, 12*b* of the circuit board 10, and the first and second tail portions 230*a*, 230*b* are also soldered to the first and second electrodes 11*a*, 11*b* of the circuit board 10.

In the above-described receptacle connector, the first and second locking pieces 340*a*, 340*b* of the shield case 300 are provided in the side walls 330 extending along the extended portions 312 of the base 310, so that the base 310 does not have any holes formed by cutting out the locking pieces. That is, the base 310 has no holes or the like, except a very narrow gap that may be left at a portion where the first and second pieces 311*a*, 311*b* are caulked and joined. When the base 310 is set in the setting region β of the circuit board 10 and the first and second locking pieces 340*a*, 340*b* are soldered to the circuit board 10, the shield case 300 configured as above is advantageous in preventing the entry of solder and flux into the body containing space α of the shield case 300. In addition, the side walls 330 linked by the linking plate 350 are resistant to inclination and/or skew, even when the plug P is twisted inside the body containing space α (if the plug P is rotated in the circumferential direction). Thus, the shield case is advantageous in reducing load applied on the folded-back portions 320 and on the soldered portions between the first and second locking pieces 340*a*, 340*b* and the circuit board 10 due to the inclination and/or skew of the side walls 330.

Furthermore, the first and second contacts 200*a*, 200*b* are buried by insert molding in the first and second bodies 100*a*, 100*b*, respectively. Therefore, the connector can be downsized preserving enough thickness of the first and second bodies 100*a*, 100*b* to hold the first and second contacts 200*a*, 200*b*. In addition, the first and second contacts 200*a*, 200*b* insert-molded into the first and second bodies 100*a*, 100*b* are resistant to distortion compared to a case where the contacts are press-fitted into the bodies. The first and second contacts 200*a*, 200*b* as such are also advantageous in reducing the pitch variation therebetween caused by distortion.

Moreover, when the first and second bodies 100*a*, 100*b* combined in the fore-and-aft direction γ are sandwiched between the abutting stop surface 313 of the base 310 and the lock pieces 370, the portions outside the elongated protrusion 140*a* of the main body 110*a* of the first body 100*a* are placed on the holders 360, the upper surface of the main body 110*a* abuts the linking plate 350, and the walls 130*a* abut the inner surfaces of the side walls 330. The first and second bodies 100*a*, 100*b* are thus securely fixed inside the shield case 300, resulting in accurate and secure positioning of the first and second contacts 200*a*, 200*b*. Particularly, the elongated protrusion 140*a* of the first body 100*a*, located near the first tail portions 230*a*, abuts the abutting stop surface 313 of the base 310 and is thereby fixed in position, so that the first and second tail portions 230*a*, 230*b* are fixed with a highly accurate mounting pitch and coplanarity.

As described above, the present receptacle connector has a configuration suitable for reduced size and height. This allows the downsizing of a mating plug P. Moreover, in the circuit board 10 of the above-described electronic equipment mounting the downsized receptacle connector, a distance between the receptacle connector and another connector for another interface can be minimized. Consequently, a unit including the receptacle connector of the electronic equipment can be minimized in size and thickness.

The above-described receptacle connector is not limited to the above-described embodiment, but may be modified in design within the scope of claims. Hereinafter, modifications are described more in detail.

Figure 10:
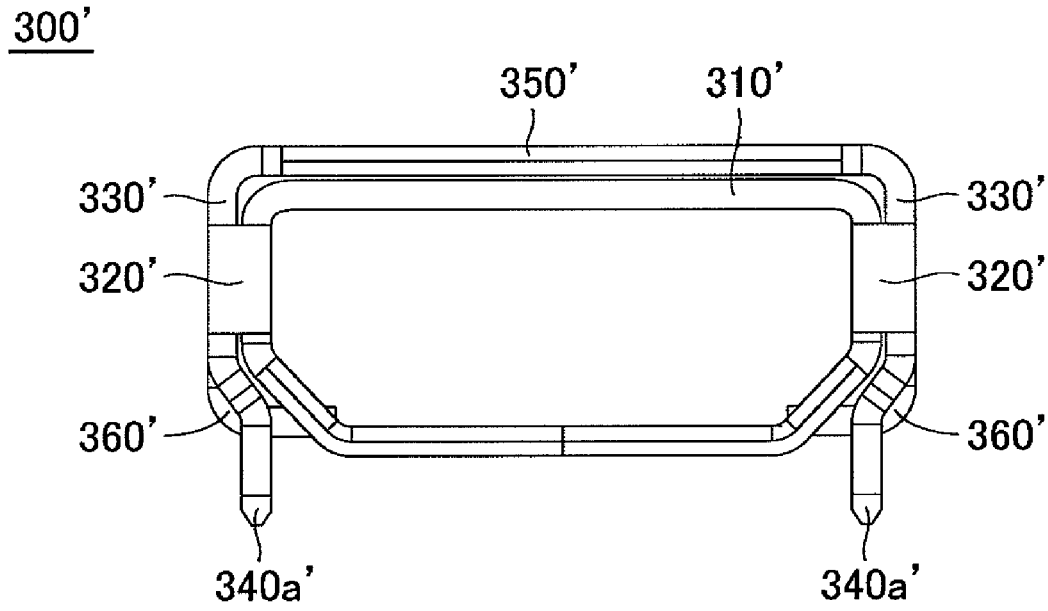
FIG. 10 is a schematic front view showing a modified design of the shield case of the connector, wherein the base is replaced with a body containing portion having a substantially O shape in front view.

First, the shield case 300 of the invention is not limited to one according to the above-described embodiment having the base 310 of generally U-shape in front view. For example, FIG. 10 illustrates a modified shield case 300', wherein the base of generally U-shape is linked at its end portions by a top plate in such a manner that the base and the top plate together form a body containing portion 310' of generally O-shape in front view (rectangular tuboid shape). The modified shield case 300' has a substantially same configuration as that of the shield case 300, except that folded-back portions 320' are provided in the widthwise end portions of the body containing portion 310'.

Figure 11:
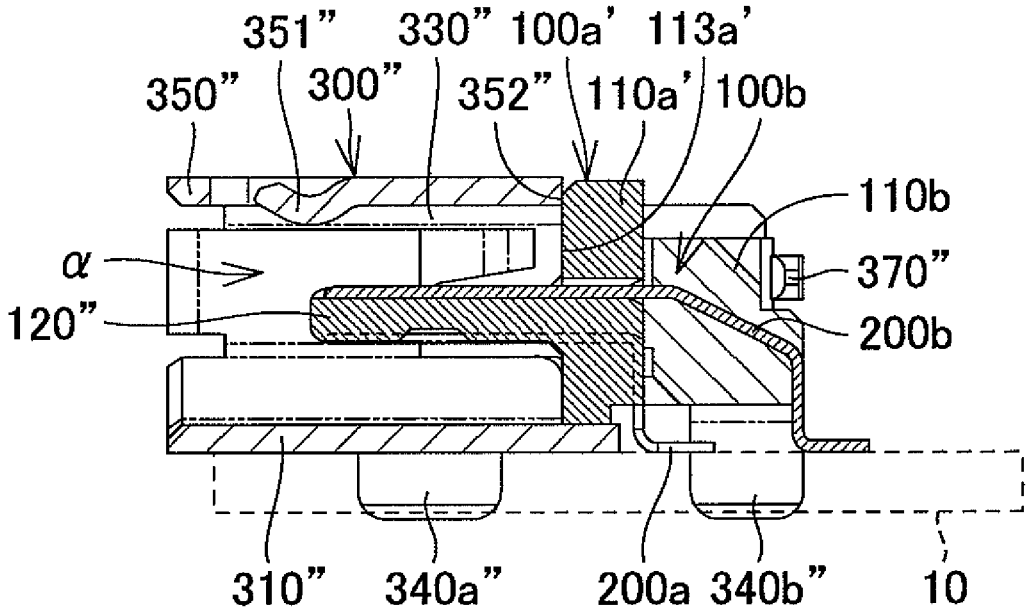
FIG. 11 is a schematic cross-sectional view showing a modified design of the connector.

Moreover, the shield case 300 may have the first and second locking pieces 340*a*, 340*b* as in the above-described embodiment, but provision of at least the first locking pieces 340*a* will suffice. Obviously, the shield case 300 may have three or more pairs of locking pieces. Moreover, the first locking pieces 340*a* may be or may not be positioned forward of the front surface 113*a* of the first body 100*a*. Moreover, the first and second locking pieces 340*a*, 340*b* only need to extend downward from lower ends of the side walls 330, and they may be extended obliquely downward from the lower ends of the side walls 330. Moreover, the holders 360 may be omitted. If the holders 360 are omitted, a portion of the first body 100*a* may be placed on the base 310 (that is, the lower surface of the main body 110*a* of the first body 100*a* may abut the base 310, and the upper surface of the main body 110*a* may abut the linking plate 350). Alternatively, a portion of the first body 100*a* may be placed on a base 310" as shown in FIG. 11. Further alternatively, the first body 100*a* may be placed on both the holders and the base. The modifications recited in this paragraph can be applied to the shield case 300'.

Moreover, the linking plate 350 in the above-described embodiment is a plate that links the upper end portions of the side walls 330, but it may be in any form that can link the side walls 330. For instance, the linking plate 350 may be provided separately from the side walls 330 to bridge between and link the side walls 330. Moreover, the length dimensions of the linking plate 350 and the side walls 330 may be and may not be larger than the length dimension of the base 310. For instance, FIG. 11 illustrates a shield case 300" having a linking plate 350" of a smaller length dimension than that of a base 310". In this case, a back surface of the linking plate 350" may function as an abutting stop surface 352", on which a front surface 113*a'* of a first body 100*a'* may abut. That is, the first and second bodies 100*a'* and 100*b* may be sandwiched between the abutting stop surface 352" and lock pieces 370". In this case, the elongated protrusion 140*a* can be omitted.

The lock pieces 370 may provided in the back surfaces of the side walls 330, but they may be provided in the linking plate 350. Moreover, the lock pieces 370" may also be provided in the base 310". In this case, widthwise end portions of a bottom plate of the base 310" may be extended to have a substantially same length as that of the side walls 330", and back end surfaces of the widthwise ends may be provided with the lock pieces 370". Moreover, the lock pieces 370 or 370" may or may not abut on the hills 130*b* of the second body 100*b*. The lock pieces may abut any portions of the second body as long as they can sandwich the first and second bodies between the abutting stop surface and themselves.

The base 310 in the above-described embodiment is configured to have the base body 311 and the extended portions 312, but may be in any form with a generally U-shape in front view. Moreover, the present invention is not limited to a case of the above-described embodiment where the first piece 311*a* has the first recess 311*a*1 and the pair of first protrusion 311*a*2, and where the second piece 311*b* has the second protrusion 311*b*1 and the second recesses 311*b*2. The first piece 311*a* should have at least the first recess 311*a*1, and the second piece 311*b* should have at least the second protrusion 311*b*1. Moreover, instead of dividing the base 310 into two pieces, the linking plate 350 may be divided in the width direction into two (first and second) pieces, so that a protrusion of the second piece may be fitted into a recess of the first piece. The modifications recited in this paragraph can also be applied to the shield case 300'.

The receptacle connector of the invention may have the first and second bodies as in the above embodiment or may have a single body. Alternatively, the connector may have three or more bodies combined in the fore-and-aft direction γ. The fitting projections 120*b* may be provided in the back surface (surface facing the second body) of the first body 100*a*, and the fitting recesses 112*a* may be provided in the front surface (surface facing the first body) of the second body 100*b*. It is also possible to omit the fitting projections 120*b* and the fitting recesses 112*a*. While the elongated protrusion 140*a* of the above embodiment is provided in the lower surface of the main body 110*a*, the invention is not limited thereto but may have any protruded portion that can abut on the abutting stop surface 313 and is located near the first tail portions.

Figure 12A:
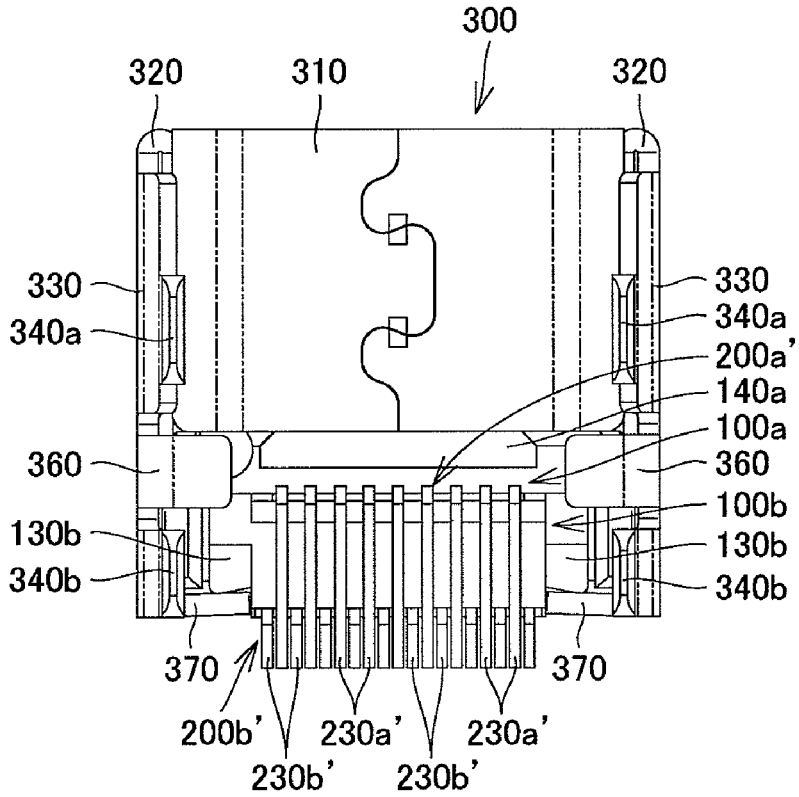
FIGS. 12A and 12B are schematic views showing modified designs of the first and second tail portions of the first and second contacts of the connector.
Figure 12B:
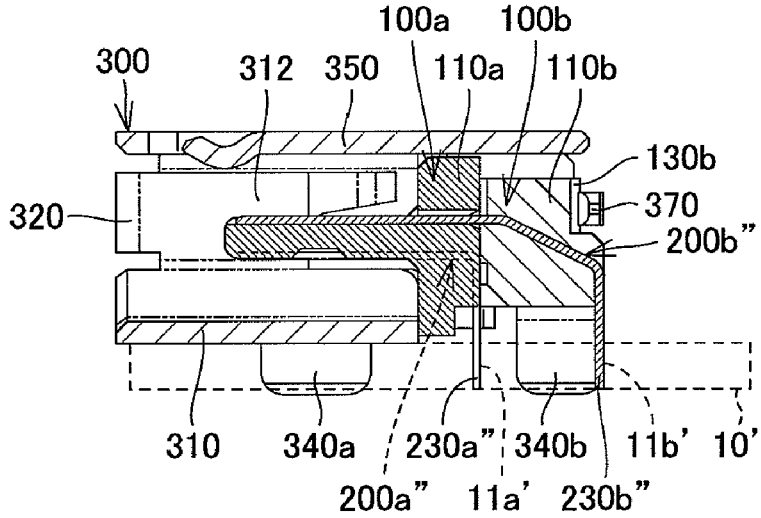

The receptacle connector of the invention may have the first and second contacts or may have one type of contacts. The receptacle connector may also have three or more types of contacts arranged in three or more rows. The present invention is not limited to a case of the above-described embodiment where the first and second tail portions 230*a*, 230*b* are arranged in two rows in the fore-and-aft direction, with the first and second bodies 100*a*, 100*b* combined. FIG. 12A illustrates a modified connector wherein first tail portions 230*a*' are made longer to align back ends of the first and second tail portions 230*a*' and 230*b*' in a row. FIG. 12B illustrates another modified connector wherein first and second tail portions 230*a*", 230*b*" extend downward into first and second through-holes 11*a*', 11*b*' of a circuit board 10' and are connected by dip soldering process. It is also possible to arrange the first and second tail portions 230*a*', 230*b*' in a row so as to be soldered into the first and second through-holes 11*a*', 11*b*' that are also arranged in a row. Furthermore, the invention may be configured such that a portion of each of the first and second contact portions is bent in a direction close to each other. For example, distal end portions of the first contact portions 220*a* may be bent upward, and distal end portions of the second contact portions 220*b* may be bent downward.

The materials, shapes, numbers, dimensions etc. of the respective elements of the receptacle connector in the above-described embodiment have been described by way of example only, the receptacle connector of the invention may be modified in design in any manner as long as similar functions can be realized. While the present invention is described in the above-described embodiment as an HDMI receptacle connector, the present invention is not limited thereto but can be applied to any board-mounting type connectors. Moreover, while the television receiver is mentioned above as exemplifying the electronic equipment, the present invention is not limited thereto.

REFERENCE SIGNS LIST

10 Circuit board
- 11*a* First electrode
- 11*b* Second electrode
- 12*a* First locking hole
- 12*b* Second locking hole

100*a* First body
- 110*a* Main body
  - 111*a* Hole
  - 112*a* Fitting recess
  - 113*a* Front surface (abutting surface)
- 120*a* Projected portion
  - 121*a* First long groove
  - 122*a* Second long groove
- 130*a* Wall
- 140*a* Elongated protrusion

100*b* Second body
- 110*b* Main body
- 120*b* Fitting protrusion
- 130*b* Hill

200*a* First contact
- 210*a* First buried portion
- 220*a* First contact portion
- 230*a* First tail portion

200*b* Second contact
- 210*b* Second buried portion
- 220*b* Second contact portion
- 230*b* Second tail portion

300 Shield case
- 310 Base
  - 311*a* First piece
    - 311*a*1 First recess
    - 311*a*2 First protrusion
  - 311*b* Second piece
    - 311*b*1 Second protrusion
    - 311*b*2 Second recess
- 312 Extended portion (widthwise end portions of the base)
  - 313 Abutting stop surface
- 320 Folded-back portion
- 330 Side wall
- 340*a* First locking piece
- 340*b* Second locking piece
- 350 Linking plate (linking portion)
- 360 Holder
- 370 Lock piece α Body containing space (body containing portion)

The invention claimed is:

1. A shield case comprising:

a base of a generally U-shape in front view, including a first plate and a pair of second plates, the second plates rising from widthwise ends of the first plate and each including an end face in a lengthwise direction of the shield case;

a pair of side walls, extending on outer sides of and in parallel with the second plates of base and each including an end face in the lengthwise direction;

a pair of folded-back portions, each extending from the end face of each of the second plates of the base to the end face of each of the side walls;

a pair of first locking pieces, extending downward from the side walls; and a linking portion adapted to link between the side walls above the second plates of the base and face the first plate of the base, wherein the base, the side walls, and the linking portion define a body containing portion.

2. The shield case according to claim 1, further comprising a top plate for connecting the second plates of the base, wherein the top plate is provided between the linking portion and the first plate of the base.

3. The shield case according to claim 1, wherein the first locking pieces are provided on lower ends of the side walls, and the linking portion links between upper ends of the side walls.

4. The shield case according to claim 3, wherein the body containing portion is adapted to contain a body, and the body has an abutting surface on which a distal end surface of a plug is abuttable, and the first locking pieces are disposed forward of the abutting surface of the body contained in the body containing portion.

5. The shield case according to claim 3, further comprising a pair of second locking pieces extending downward from the lower ends of the side walls.

6. The shield case according to claim 3, wherein the body containing portion is adapted to contain a body, the side walls and the linking portion are larger in length than the base, the side walls have non-facing regions at lower ends thereof, the non-facing regions not facing the base, the shield case further comprises a pair of holders each having a facing surface adapted to face the linking portion, a vertical distance between the facing surfaces of the holders and the linking portion is substantially the same as a height dimension of the body, and a lower surface of the body is abuttable on the holders, and an upper surface of the body is abuttable on the linking portion.

7. The shield case according to claim 1, wherein the base or the linking portion has a first piece provided with a recess and a second piece provided with a protrusion, and the first and second pieces are caulked in a state where the protrusion is fitted into the recess.

8. A receptacle connector comprising:

the shield case according to claim 1, a body contained in the body containing portion of the shield case, and a plurality of first contacts disposed in the body, the first contacts being arranged in a row in a width direction of the receptacle connector.

9. The receptacle connector according to claim 8, further comprising a plurality of second contacts disposed in the body, the second contacts being arranged in a different row from the row of the first contacts, in the width direction of the receptacle connector.

10. The receptacle connector according to claim 9, wherein the body comprises first and second bodies combined in a fore-and-aft direction that is the lengthwise direction, the first contacts are buried in the first body, the second contacts are buried in the second body and arranged at a different height position from a height position of the first contacts in a state where the first and second bodies are combined, the base of the shield case is smaller in length than the linking portion, and a back surface of the base functions as an abutting stop surface on which the first body abuts, and the back surfaces of the side walls or the back surface of the linking portion of the shield case is provided with a lock piece, and the first and second bodies are sandwiched between the abutting stop surface and the lock piece.

11. The receptacle connector according to claim 9, wherein the body comprises first and second bodies combined in a fore-and-aft direction that is the lengthwise direction, the first contacts are buried in the first body, the second contacts are buried in the second body and arranged at a different height position from a height position of the first contacts in a state where the first and second bodies are combined, the linking portion of the shield case is smaller in length than the base, and a back surface of the linking portion functions as an abutting stop surface on which the first body abuts, and the back surfaces of the side walls or the back surface of the base of the shield case is provided with a lock piece, and the first and second bodies are sandwiched between the abutting stop surface and the lock piece.

12. The receptacle connector according to claim 10, wherein the first body has a fitting protrusion on a surface thereof facing the second body and the second body has a fitting recess in a surface thereof facing the first body, or alternatively the first body has a fitting recess in a surface thereof facing the second body and the second body has a fitting protrusion on a surface thereof facing the first body, and the fitting protrusion fits into the fitting recess in a state where the first and second bodies are combined.

13. The receptacle connector according to claim 11, wherein the first body has a fitting protrusion on a surface thereof facing the second body and the second body has a fitting recess in a surface thereof facing the first body, or alternatively the first body has a fitting recess in a surface thereof facing the second body and the second body has a fitting protrusion on a surface thereof facing the first body, and the fitting protrusion fits into the fitting recess in a state where the first and second bodies are combined.

14. The receptacle connector according to claim 10, wherein the first body comprises:

a main body of a generally rectangular shape in cross-sectional view, having a front surface that functions as an abutting surface on which a distal end surface of a plug is abuttable;

a projected portion, projected from the front surface of the main body; and a protruded portion, provided on a lower surface of the main body and abuttable on the abutting stop surface, the projected portion has first and second surfaces in a thickness direction thereof, the first and second surfaces being provided with first long grooves and second long grooves, respectively, extending in the fore-and-aft direction, the main body further has holes communicating with the second long grooves, each of the second contacts has:

a second buried portion buried in the second body;

a second contact portion continued from a lengthwise end of the second buried portion and received in one of the holes and one of the second long grooves; and a second tail portion continued from the other lengthwise end of the second buried portion, and each of the first contacts has:

a first buried portion buried in the main body of the first body;

a first contact portion continued from a lengthwise end of the first buried portion and received in one of the first long grooves of the projected portion; and a first tail portion continued from the other lengthwise end of the first buried portion and disposed near the protruded portion.

15. The receptacle connector according to claim 14, wherein the base has a facing surface adapted to face the linking portion and the linking portion has a facing surface adapted to face the base, a vertical distance between the facing surface of the base and the facing portion of the linking portion is substantially the same as a height dimension of the main body, and a lower surface of the main body abuts the base, and an upper surface of the main body abuts the linking portion.

16. The receptacle connector according to claim 14, wherein the first and second tail portions are arranged in two rows in the fore-and-aft direction.

17. The receptacle connector according to claim 14, wherein the first and second contacts are arranged in a zigzag manner, and the first and second tail portions are aligned in a row.

18. The receptacle connector according to claim 15, wherein the first and second tail portions are hung downward.

19. The receptacle connector according to claim 16, wherein the first and second tail portions are hung downward.

20. An electronic equipment comprising the receptacle connector according to claim 8 serving as an external interface thereof.

* * * * *